US005097242A

United States Patent [19]

Onishi et al.

[11] Patent Number: 5,097,242

[45] Date of Patent: Mar. 17, 1992

[54] PULSE GENERATOR PICK UP COIL ASSEMBLY

[75] Inventors: Masayoshi Onishi; Hisato Umemaru, both of Himeji, Japan

[73] Assignee: Mitsubishi Denki Kabushiki Kaisha, Tokyo, Japan

[21] Appl. No.: 375,788

[22] Filed: Jul. 5, 1989

[30] Foreign Application Priority Data

Jul. 8, 1988 [JP] Japan ..... 63-91294[U]
Jul. 8, 1988 [JP] Japan ..... 63-91296[U]

[51] Int. Cl.[5] ..... H01F 27/30

[52] U.S. Cl. ..... 336/192; 307/106; 361/405; 361/408

[58] Field of Search ..... 307/106; 336/192; 361/405, 408

[56] References Cited

U.S. PATENT DOCUMENTS 3,496,504 2/1970 Daley ..... 336/192
4,096,735 6/1978 Huntzinger et al. ..... 73/35
4,122,424 9/1978 Plunkett ..... 336/192
4,166,265 8/1979 Reynolds et al. ..... 336/192
4,849,728 7/1989 Goll et al. ..... 336/192
4,931,728 6/1990 Hata et al. ..... 336/192

*Primary Examiner*—A. D. Pellinen
*Assistant Examiner*—Jeffrey A. Gaffin
*Attorney, Agent, or Firm*—Sughrue, Mion, Zinn, Macpeak and Seas

[57] ABSTRACT

A pulse generator is constructed and arranged such that, by bringing a piece to be detected into contact or making it disconnect with regard to a detecting head at the tip end of a magnetic iron core, the magnetic flux in interlinkage with a detecting coil is caused to change, and by bending almost at right angles a terminal in connection with both the detecting coil and a leading wire, the tension occurring on the leading wire is not transmitted to connections between the detecting coil and the terminal.

8 Claims, 4 Drawing Sheets

PULSE GENERATOR PICK UP COIL ASSEMBLY

BACKGROUND OF THE INVENTION

1. Field of the Invention

This invention relates to a pulse generator for use as a speed detector and more particularly to improvements in the wiring system of a detecting coil.

2. Description of Related Art

FIG. 1 is, for example, a longitudinal sectional view showing the construction of a conventional pulse generator disclosed in Japanese Utility Model Application Laid-Open No. 63-143058. This pulse generator is used for detecting the speed of an automobile, being attached to an automobile transmission case and detecting the rotational frequencies of inner gears. In the fig., the reference character 1 indicates a nearly cylindrical case with a bottom, and within said case 1 is disposed a cylindrical detecting coil 2 wound around a bobbin 3. Centrally at the bottom face of the case 1 is formed a hole having a diameter almost equal to the inner diameter of the bobbin 3. A round bar-shaped magnetic iron core 4 is inserted through both the bobbin 3 and the hole, such that one end thereof is made to outwardly protrude from the bottom of the case 1. Said one end thereof constitutes a detecting head 4*a*. The other end of the magnetic iron core 4, is diametically expanded, and in contact with a biasing magnet 5 having the same diameter. In addition, upwardly thereof is disposed a spacer 6 for increasing the magnetic flux.

Both ends of the detecting coil 2 are led up to solder tabs 8*a*, 8*a* at the ends of two terminals 8, 8 provided upwardly of the detecting coil 2. Other ends of the terminals 8, 8 are formed crimping portions 8*b*, 8*b* for crimping lead wires 7, and, by the lead wires 7, 7 crimped there, a signal is outputted toward the outside. The lead wires 7, 7 and the terminals 8, 8 are internally inserted and fixed by a molded element 10. Connections between the upper portion of the detecting coil 2 and the tabs 8*a*, 8*a* are wrapped with a tape 9.

The pulse generator arranged as described above is built up in accordance with the following procedure. Both ends of the detecting coil 2 wound around the bobbin 3 are led up to the tabs 8*a*, 8*a* of the terminals 8, 8, and then connections between them are soldered. After the connections are taped by means of the tape 9, with a leg 10*a* of the molded element 10 biasing the magnet 5 towards the magnetic iron core 4 through the spacer 6, the case 1 is inserted and formed. The pulse generator is available in this manner.

The action of a conventional pulse generator will now be described as follows. When, in the passage of a piece to be detected (not illustrated) such as a tooth tip face of a gear with regard to the detecting head 4*a*, the amount of magnetic resistance change in a magnetic circuit, a portion formed by the magnetic iron core 4, the air-gap and the piece to be detected, reaches the maximum, the change in the magnetic flux in interlinkage with the detecting coil 2 becomes the maximum, and subsequently, the output voltage of the pulse generator then becomes the maximum. On the other hand, when the amount of magnetic resistance change in a magnetic circuit, a portion formed by the magnetic iron core 4, the air-gap and the piece to be detected, reaches the minimum, the change in the magnetic flux in interlinkage with the detecting coil 2 becomes the minimum, and subsequently, the output voltage of the pulse generator becomes the minimum. Consequently, the output voltage of the pulse generator takes the form of an almost sine wave.

With the conventional pulse generator described above, there has been a problem in that tension carelessly applied on the side of wires 7 is instantly transmitted to the terminal 8, forcing the tabs 8*a*, 8*a* to instantly and axially move and the end of thin wire of the detecting coil 2 is finally broken there. While the tabs 8*a*, 8*a* are taped by the tape 9, in order to prevent the end of a winding from slipping off, there has been another problem in that, tension occurring during winding is inevitably released to slacken the winding, the coil still remains slack even if it is taped by means of the tape 9, and the end of thin wire of the detecting coil 2 is broken due to vibration during the use of it or when it is afterward handled.

SUMMARY OF THE INVENTION

This is an invention to settle the above mentioned problems involved in the prior art, and the primary object of the invention is to provide a reliable pulse generator constructed and arranged such that, a terminal is bent at right angles so that the tension is not instantly transmitted to a solder tab even if a lead wire is pulled, and the wire at the end of a detecting coil is not broken by pulling of the leading wire in the transverse direction.

The second object of this invention is to provide a reliable pulse generator constructed and arranged such that, by providing an anchor projection having the relatively small diameter for engaging the end of the wound up detecting coil formed as one integrated body with a bobbin, the detecting coil is prevented from slackening during the winding process, and the wire at the end of the detecting coil is not broken by vibration.

The above and further objects and features of the invention will more fully be apparent from the following detailed description with accompanying drawings.

DESCRIPTION OF THE PREFERRED EMBODIMENTS

Figure 1:
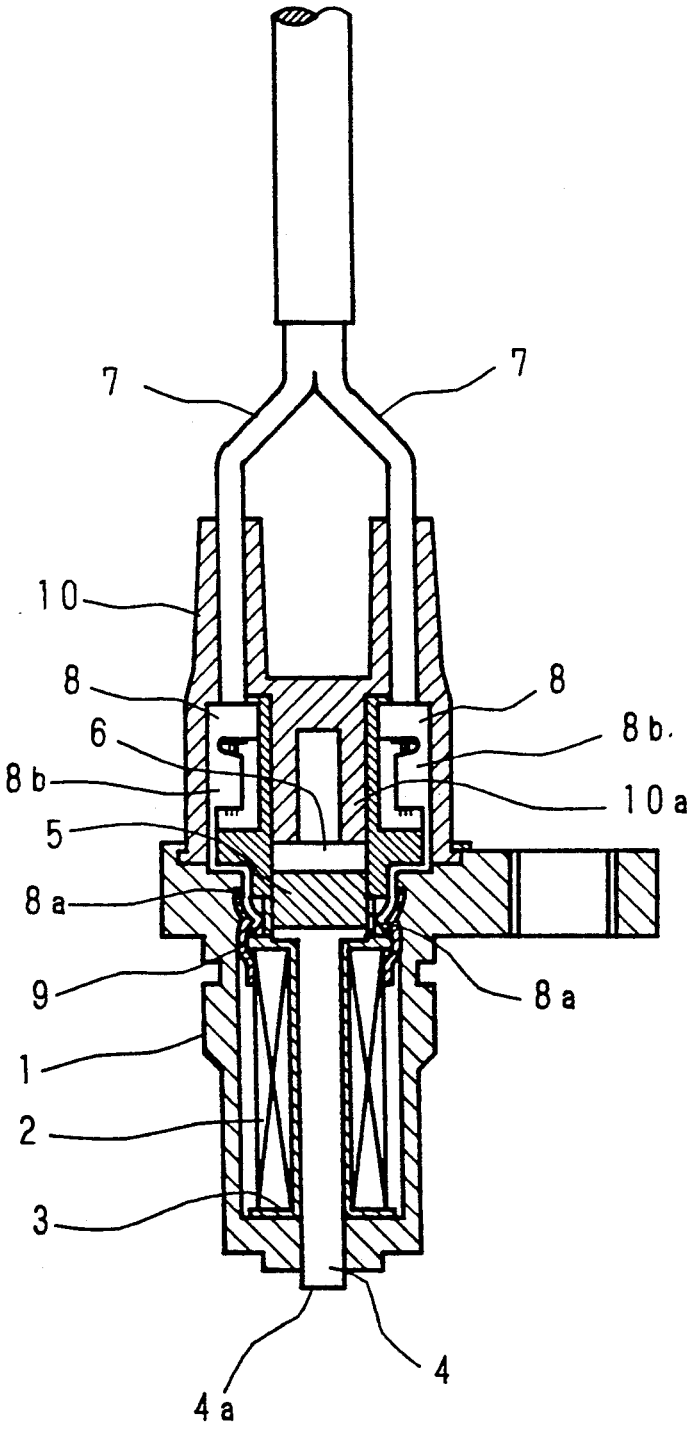
Fig. 1 Prior Art
FIG. 1 is a sectional view showing a conventional pulse generator.
Figure 2:
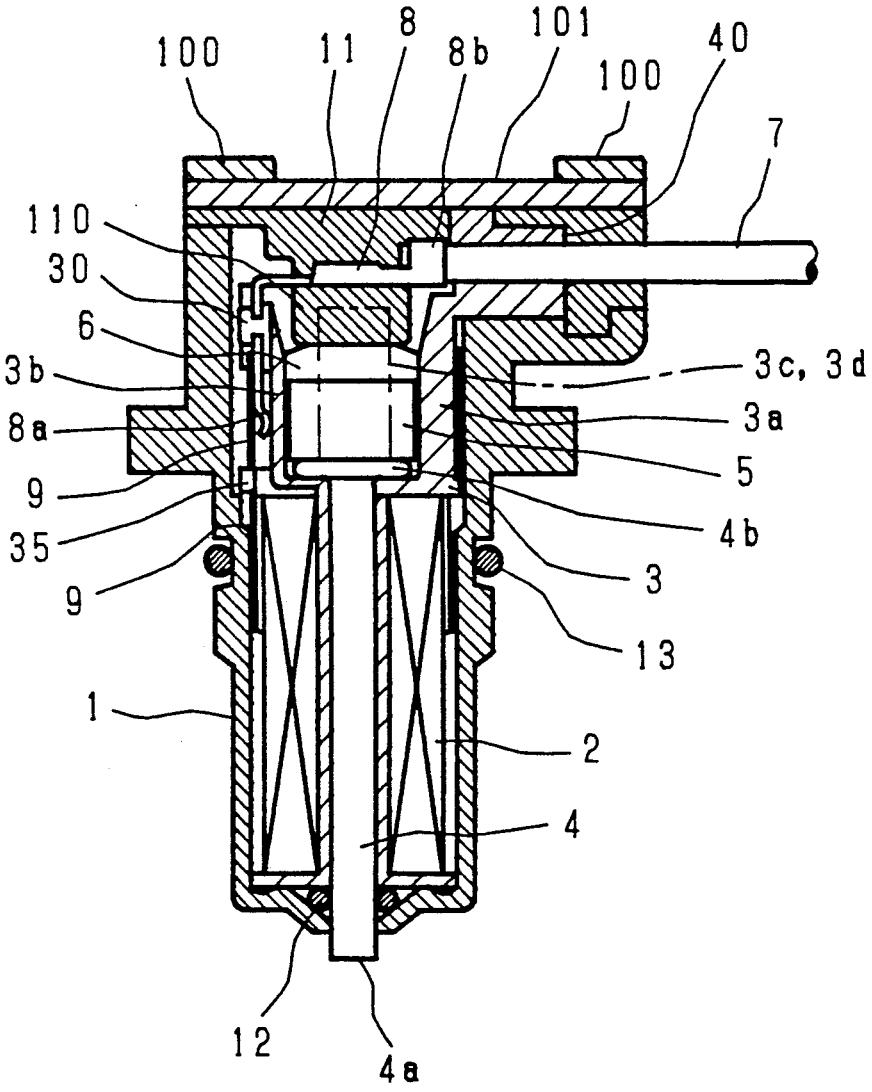
FIG. 2 is a sectional view showing a pulse generator of the present invention, FIG. 3(*a*) is a front view showing an element of the pulse generator in FIG. 2, which is partly taken away for clarification, in the process of being built up, FIG. 3(*b*) is a sectional view thereof.

Referring to the drawings illustrating one embodiment, the invention will now be described in detail as follows:

In FIG. 2, the reference character 1 indicates a nearly cylindrical case having the bottom at its lower portion, and within the case 1 is disposed a cylindrical detecting coil 2 wound around a bobbin 3. Centrally at the bottom face is formed a hole having the diameter almost equal to the inner diameter of the bobbin 3.

Figure 3B:
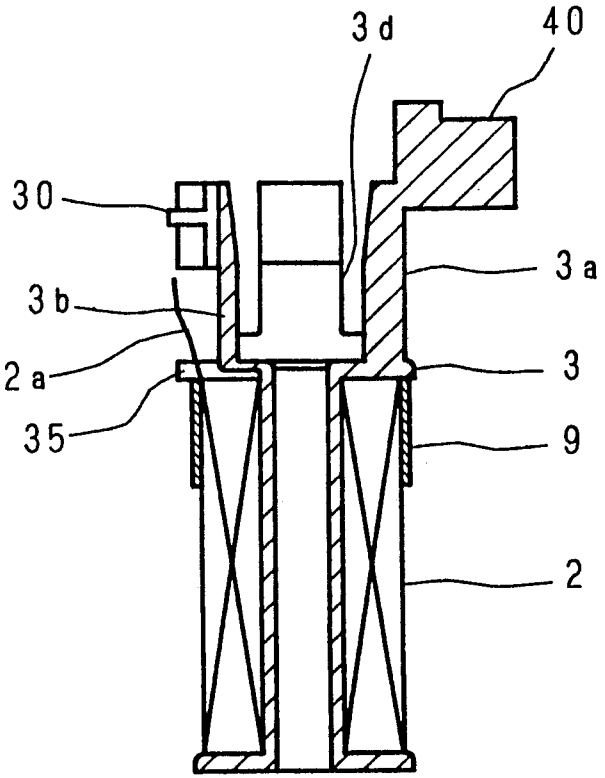
Figure 3A:
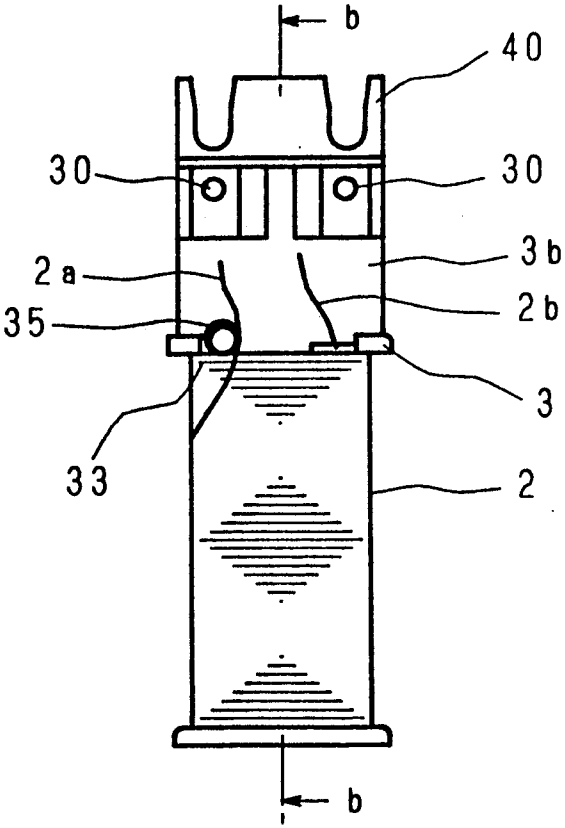

FIG. 3 is a view showing the constructions of the bobbin and the detecting coil as well as illustrating the process of winding the detecting coil around the bobbin. FIG. 3(*a*) is a front view showing the bobbin, and FIG. 3(*b*) is a sectional view taken along the line B—B in FIG. 3(*a*). The bobbin 3 is composed by synthetic resin, and thereupon are uprightly formed four legs 3*a*, 3*b*, 3*c*, 3*d* as one integrated unit (the leg 3*c* is not illustrated). Each of the legs 3*a*, 3*b*, 3*c*, 3*d* is in the form of an almost flat sheet, and the legs 3*a* and 3*b*, and the legs 3*c* and 3*d* are oppositely spaced by the predetermined distance respectively. At the root of the leg 3*b* is formed and resined an anchor projection 35 having a relatively small diameter as one unit, and at the upper portion thereof are formed anchor posts 30, 30 for anchoring two terminals 8, 8 which will be later described. At the upper portion of the leg 3*a* is formed a lead supporter 40 extending in the diametric direction of the detecting coil 2, the lead wires 7 being made to externally protrude in the diametric direction.

After the winding of the detecting coil 2 is completed, an end 2*a* thereof is wound around the anchor projection 35 so that the end 2*a* of the detecting coil 2 may not be slackened. An end 2*b*, an initial portion of the detecting coil 2 to be wound, is retained by the detecting coil 2 itself, being thereby prevented from slackening. After the completion of winding the end 2*a* around the anchor projection 35, the upper portion of the detecting coil 2 is taped by means of a tape 9.

Figure 5:
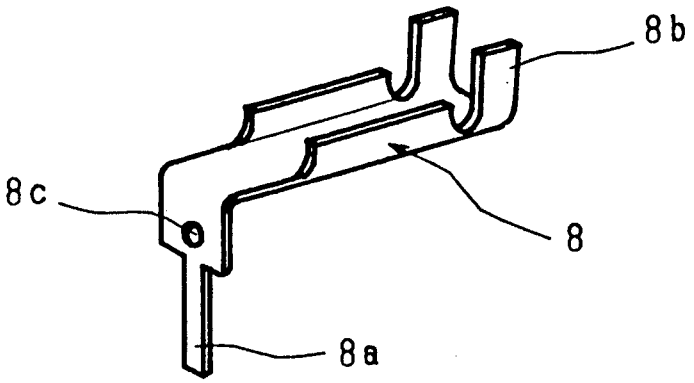
FIG. 5 is a perspective view showing a terminal.
Figure 4:
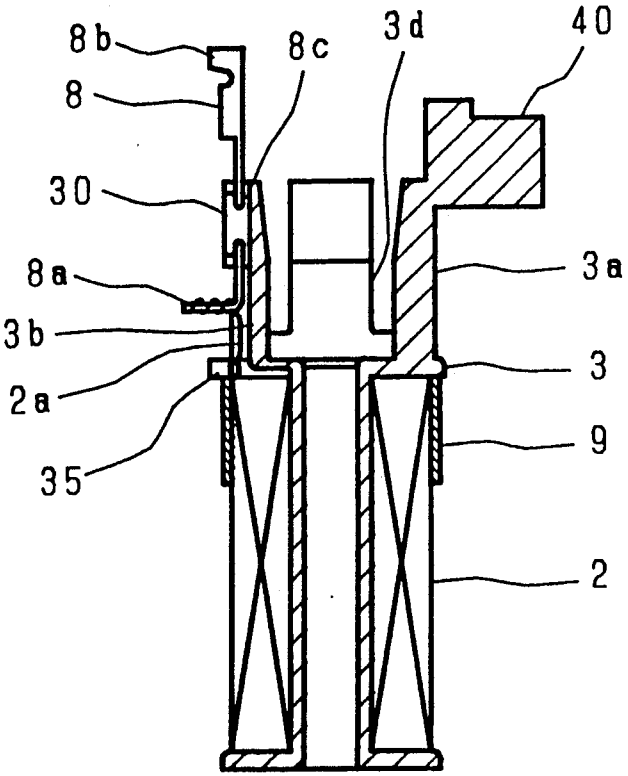
FIG. 4 is a sectional view showing an element of the pulse generator in FIG. 2, which is partly taken away for clarification, in the process of being built up.

FIG. 4 is a sectional view showing the process of leading up the end of a detecting coil to a terminal, and FIG. 5 is a perspective view showing the terminal. The terminals 8, 8 have at one ends thereof crimping portions 8*b*, 8*b* connecting thereto lead wires 7 for outputting a signal to the outside, also having at other ends thereof tab portions 8*a*, 8*a* for connection to both ends 2*a*, 2*b* of the detecting coil 2, and between them are formed holes 8*c*, 8*c* to be engaged with the anchor posts 30, 30 of the bobbin 3. The tab portions 8*a*, 8*a* are bent toward the outside as illustrated so that the ends 2*a*, 2*b* may be easily wound therearound. By fitting the holes 8*c*, 8*c* to the posts 30, 30, the terminals 8, 8 are temporarily retained by the leg 3*b*, being soldered for obtaining proper electrical connections after both the ends 2*a*, 2*b* of the detecting coil 2 are wound around the tabs 8*a*. Then, the tabs 8*a*, 8*a* are bent downwardly and the circumferences thereof are taped by means of the tape 9. The terminals 8, 8 are bent at right angles between the holes 8*c*, 8*c* and the crimping portions 8*b*, 8*b* as illustrated in FIG. 5.

Being inserted through the central hole of the bobbin 3, a round bar-shaped magnetic iron core 4 is provided such that one end thereof is made to protrude from the bottom of the bobbin. Said one end thereof constitutes a detecting head 4*a*. The other end of the magnetic iron core 4 constitutes a diametrically expanded coming off preventing portion 4*b*, being in contact with a biasing magnet 5 having the same diameter. At the upper portion thereof is disposed a spacer 6 for increasing the magnetic flux. By means of the four legs 3*a*, 3*b*, 3*c*, 3*d*, both the biasing magnet 5 and the spacer 6 are disposed concentrically with the magnetic iron core 4.

The lead wires 7 pass the lead supporter 40, being crimped by the portions 8*b*, 8*b* of the terminals 8, 8 bent at right angles as illustrated in FIG. 5. The lead wires 7 are therefore extended not in the axial direction of but in the diametrical direction of the detecting coil 2.

The coil portion constructed and arranged as described above is inserted into the case 1, and through a hole provided at the lower portion of the case 1 is inserted the detecting head 4*a* of the magnetic iron core 4. To the upper portion of the case 1, a grommet 11 is fitted and a plate 101 is attached. An upper end portion 100 of the case 1 is heat-caulked and a grommet 11 is stuck to the case 1. Centrally at the grommet 11 is formed a projection 110, the tip of which is in contact with the spacer 6. This causes pressure to occur, which will then prevent the biasing magnet 5, the magnetic iron core 4 and the bobbin 3 from axially playing. In a part between the lower portion of the bobbin 3 and the bottom plate of the case 1, and outside the nearly middle part of the case 1 are placed O-rings 12 and 13 respectively to prevent lubricating oil from permeating into the case 1 or from leaking out of the transmission case.

The pulse generator of the invention constructed and arranged as described above is provided with the function similar to that of a conventional one, however, in this invention, since the lead wires 7 are pulled out in the transverse direction with regard to the case 1, tension carelessly applied to the lead wires 7 is absorbed by an area where the terminals 8 are bent at right angles, so the tension will not reach the tabs 8*a*, and therefore the thin wire of the coil end 2*a* extending from the tabs 8*a* will not be broken.

As described above, since the terminal 8 is bent at right angles between the crimping portion and the tab portion, and the lead wire 7 is pulled out in the transverse direction with regard to the main body of the case 1, the tension applied to the lead wire 7 will never axially move the tabs 8*a* of the terminal 8. Consequently a possible breaking of wire of the detecting coil 2 at the tabs 8*a* as well as a possible breaking of the anchor posts 30 which conventionally occur in the process of manufacture, at the time of inspection and in handling it afterward are eliminated. Thereby, a highly reliable pulse generator free from the breaking of wire of the coil end can be available.

Since, at the root of the leg 3*b* where the terminal 8 is attached, the bobbin 3 is provided with the anchor projection 35 having a relatively small diameter, the winding of the end 2*a* of the detecting coil 2 around the anchor projection 35 after winding it up around the bobbin 3 will cause the end 2*a* of the detecting coil 2 to remain wound around the anchor projection 35, thereby preventing the end of the detecting coil 2 from slackening and slipping off. It is easy to tape thereupon by the tape 9, the detecting coil 2 is not slackened, and there is no case that the coil end 2*a* may be scratched by an edge 33 of the bobbin 3 due to vibration and thereby broken.

The anchor projection 35 is cylindrically shaped in the embodiment as illustrated, however, it may be a polygonal column shape with sharp edges removed.

As described above, merely by winding the end of a completely wound coil around the anchor projection 35 having a relatively small diameter, which is provided to the bobbin 3, the coil end 2*a* twines itself around the anchor projection 35 sufficiently and maintains the tension enough to securely wind up the coil. Therefore, there is no case that the end of the coil slackens and slips off after winding it up, the tape 9 is easily provided thereupon, the coil 2 may not be slackened for ever, there is no conventional breaking of the coil end by being scraped against the edges of the bobbin 3 due to vibration, and consequently a highly reliable pulse generator is now available.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A pulse generator pickup coil assembly, comprising:

a) a generally cylindrical bobbin (3) defining a central, axial through hole, and having a plurality of leg members (3*a*–3*d*) extending upwardly from one end thereof, surrounding the through hole, b) a pair of anchor posts (30) individually outstanding from an upper end of one of the leg members, c) an anchor projection (35) outstanding from an upper flange of the bobbin, at a base of said one leg member, d) a pair of lead support grooves (40) defined in an upper edge of another leg member, diametrically opposite said one leg member, e) a pair of L-shaped electrical terminals (8) each having one arm disposed diametrically across said one and said another leg members, and having crimping means (8*b*) proximate said another leg member engaging an end of a lead wire (7) disposed in a support groove and extending diametrically outwardly from said assembly, and another arm depending downwardly and having an aperture (8*c*) fitted on an anchor post and an end tab (8*a*), f) a coil (2) wound around the bobbin and having ends (2*a*, 2*b*) thereof individually secured to the terminal end tabs, one of said coil ends being wound around the anchor projection, and g) a magnetic iron core rod extending through the bobbin through hole, h) such that tension applied to the lead wires is absorbed by said one leg member and the anchor posts thereof via the electrical terminals to attendantly prevent the breakage of the coil ends or their connections to the terminal end tabs.

2. A pulse generator pickup coil assembly according to claim 1, further comprising a permanent magnet (5) disposed above and abutting the core rod (4), and a spacer member (6) disposed above and abutting a magnet.

3. A pulse generator pickup coil assembly according to claim 2, further comprising a metal casing (1) surrounding the bobbin and the coil, and partially enclosing a lower end of the bobbin, and closure means (100,101) sealingly disposed over an upper end of the casing.

4. A pulse generator pickup coil assembly according to claim 2, further comprising an insulating tape (9) wrapped around the coil ends and the terminal end tabs.

5. A pulse generator pickup coil assembly according to claim 3, further comprising a grommet member (11) disposed between an underside of the closure means and an upper surface of the spacer.

6. A pulse generator pickup coil assembly according to claim 3, further comprising an insulating tape (9) wrapped around the coil ends and the terminal end tabs.

7. A pulse generator pickup coil assembly according to claim 5, further comprising an insulating tape (9) wrapped around the coil ends and the terminal end tabs.

8. A pulse generator pickup coil assembly according to claim 1, further comprising an insulating tape (9) wrapped around the coil ends and the terminal end tabs.

* * * * *